US005632103A

United States Patent [19]

Suenaga

[11] Patent Number: 5,632,103

[45] Date of Patent: May 27, 1997

[54] INSOLE OF SHOE

[76] Inventor: Tatsuhiko Suenaga, 15-21, 2-chome Shimo-Iqusa, Suginami-ku, Tokyo, Japan

[21] Appl. No.: 607,203

[22] Filed: Feb. 26, 1996

Related U.S. Application Data

[63] Continuation of Ser. No. 361,515, Dec. 22, 1994, abandoned.

[51] Int. Cl.[6] ..... A43B 13/18; A43B 13/40

[52] U.S. Cl. ..... 36/28; 36/43

[58] Field of Search ..... 36/432 SR, 44, 36/28, 71, 153, 154, 166, 169, 173, 80, 81, 174, 180

[56] References Cited

U.S. PATENT DOCUMENTS

| | | | |
|---|---|---|---|
| 1,242,363 | 10/1917 | Mueller et al. | 36/81 X |
| 3,253,601 | 5/1966 | Scholl | 36/153 |
| 3,766,669 | 10/1973 | Pearsall | 36/43 |
| 4,235,028 | 11/1980 | Riggs | 36/80 |
| 4,345,387 | 8/1982 | Daswick | 36/43 |
| 4,413,430 | 11/1983 | Brown | 36/44 |
| 4,627,178 | 12/1986 | Sullivan et al. | 36/44 |
| 4,800,657 | 1/1989 | Brown | 36/44 |
| 4,879,821 | 11/1989 | Graham et al. | 36/80 X |
| 4,910,886 | 3/1990 | Sullivan et al. | 36/43 |
| 5,068,983 | 12/1991 | Marc | 36/43 |
| 5,282,326 | 2/1994 | Schroer, Jr. et al. | 36/44 |
| 5,400,528 | 3/1995 | Skinner et al. | 36/44 |

FOREIGN PATENT DOCUMENTS

| | | | |
|---|---|---|---|
| K22803 | 7/1957 | Germany | 36/174 |

*Primary Examiner*—Ted Kavanaugh

[57] ABSTRACT

An insole for a shoe made of foam resin containing fine bubbles, the thickness of which increases from the portion corresponding to the arch of the foot to the trailing end of the heel to give a slope on said insole, the bottom edge or corner of the heel is cut to provide cavities between the cut surface of the insole and the inner surface of the shoe to allow the insole to be deformed into said cavity due to the load on the insole for guarantee of cushion.

9 Claims, 4 Drawing Sheets

INSOLE OF SHOE

This is a continuation of application Ser. No. 08/361,515 filed Dec. 22, 1994, now abandoned.

FIELD OF THE INVENTION

The present invention relates to an improvement in the structure of an insole for shoes, particularly sports shoes, and in particular to an insole which has a structure designed to absorb shock generated during walking or running and which is insertable into and removable from standard shoes which are widely available in the market.

DESCRIPTION OF THE PRIOR ART

Recently, a means for absorbing shocks such as those imparted on the heels, ankles, knees, waist, etc. during various types of walking and running such as "normal" walking while commuting or shopping etc., walking or jogging to promote health, for handicapped persons who have troubles in walking, walking for the training or rehabilitation of persons suffering from injuries or handicaps, and the like (referred to hereinafter simply as walking) has been in great demand.

As a means for absorbing such types of shocks in general, insoles for shoes, either formed integrally with the normal sole (hereinafter referred to as inside sole) by adhesion, or as a loose sole additionally placed inside the shoe (hereinafter referred to as a loose sole) which absorb the shock of the foot coming into contact with the ground by means of the elasticity of the materials of which it is formed, an elastic structure such as that having numerous projections on the lower surface of the sole, or a structure wherein the sole is broader in the heel in order to disperse the load imparted thereon, have been known.

However, among the conventional insoles for shoes mentioned above, none provide the type of support necessary for handicapped persons to maintain a healthy and beneficial posture while walking.

Also, there is great demand for shoes and insoles which have substantially improved shock-absorbing ability.

Further, in the conventional loose sole, there has been a problem in that the configuration of such loose soles at the area of the arch of the foot does not fit the inner shape of the shoe, resulting in unexpected distortion of the loose sole in that area of the arch of the foot, stressing abnormally the arch of the foot of the person wearing the shoe.

Accordingly, an object of the present invention is to provide an insole having superior shock-absorbing ability.

Another object of the present invention is to provide an insole having a slope provided on the insole from the uppermost portion of the heel to the area of the arch of the foot.

Another object of the present invention is to provide a shoe having a shock-absorbing inside sole with a structure by which persons wearing the shoes provided with this inside sole, particularly handicapped persons, are able to assume a proper posture while walking.

Still another object of the present invention is to provide a loose sole which is able to fit with the inner structure of a shoe into which the loose sole is intended to be inserted.

SUMMARY OF THE INVENTION

In order to attain the above objects, a first aspect of the present invention is characterized in that the inside sole provided by adhesion on the inner surface of a shoe comprises a thicker portion which is formed by making the inside sole increasingly thicker from the portion of the arch of the foot to the heel portion, whereby a slope is formed from the uppermost portion of the heel to the area of the arch of the foot portion.

Further, the bottom corner in sectional view of the inside sole along from the arch of the foot to the heel is cut to form a triangular cavity surrounded by the inner surface of the sole, the side wall of the shoe and the cut surface of the inside sole.

The second aspect of the present invention is characterized by a structure of a loose sole having the same structure as the inside sole of the first aspect.

Further, a third aspect is characterized in that the material to be used in the insole of the present invention is a foam resin comprising fine bubbles.

According to the present invention, due to the slope formed on the insole from the uppermost portion of the heel to the portion of the arch of the foot, a person wearing such shoes is urged to take an upright posture, inclining forward.

Further, according to the present invention it is intended that persons, particularly injured or handicapped persons, do not become tired due to displacement of their center of gravity during forward inclination of the body, and forward movement of the feet is assisted.

Due to the cavity formed by the cut-out section in the bottom corner of the insole, the insole is deformed into said cavity to guarantee a cushioning ability.

Particularly, as to the loose sole, the cut of the bottom portion corresponding to the area of the arch of the foot does not form such a cavity as in the heel portion, but fits easily with the inner shape of the shoe at the arch of the foot.

DETAILED DESCRIPTION OF THE INVENTION

Figure 3:
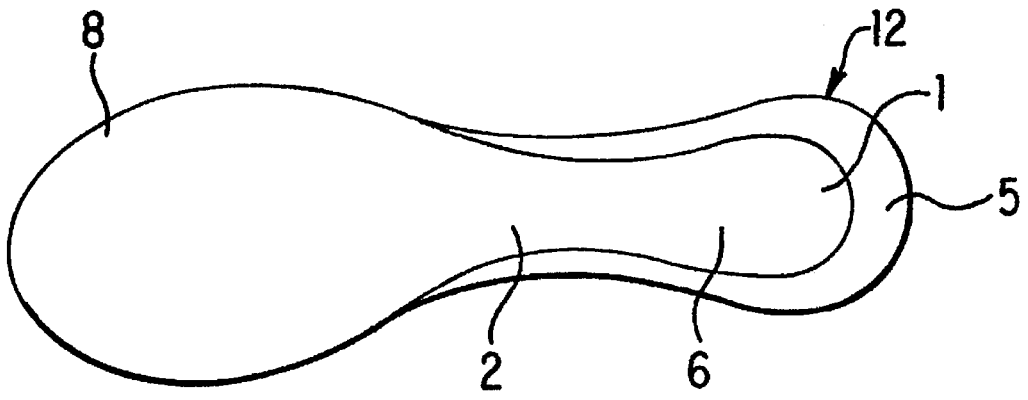
FIG. 3 is a bottom view of the insole of FIG. 2.
Figure 4:
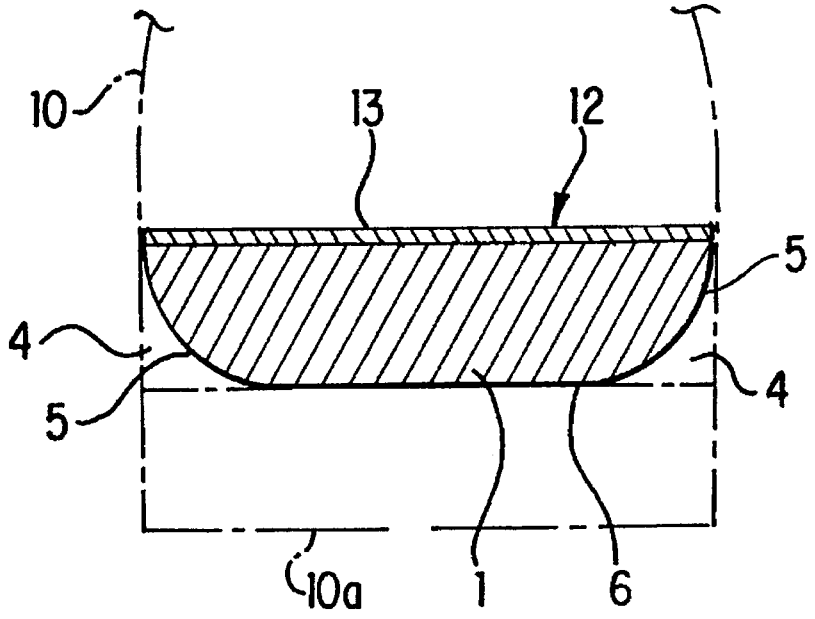
FIG. 4 is an enlarged sectional view along line 4—4 of FIG. 2.
Figure 5:
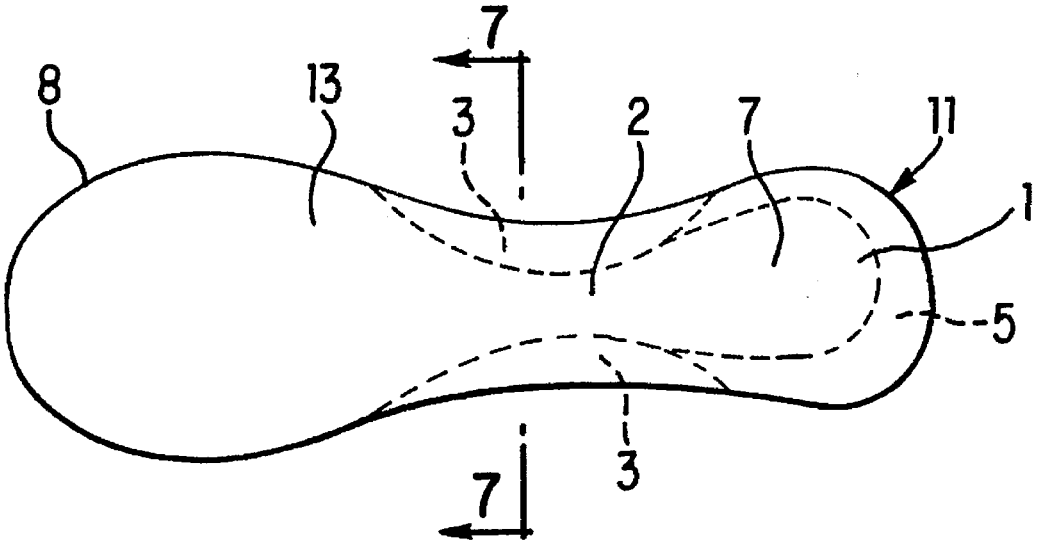
FIG. 5 is a plan view of a loose sole according to the present invention.
Figure 6:
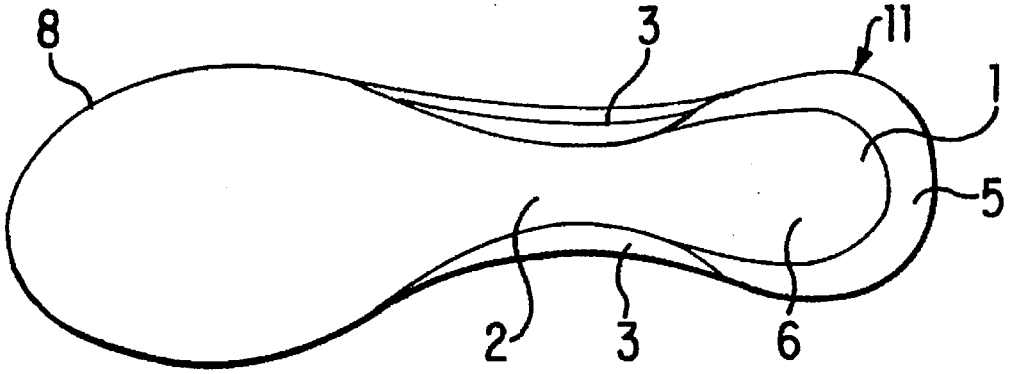
FIG. 6 is a bottom view of FIG. 5.

FIGS. 1–4 are for illustrating an insole of the present invention, which is the inside sole formed integral with a sole and FIGS. 5–6 are for illustration of a loose strip type of insole which is to be inserted into a shoe before wearing it.

Figure 1:
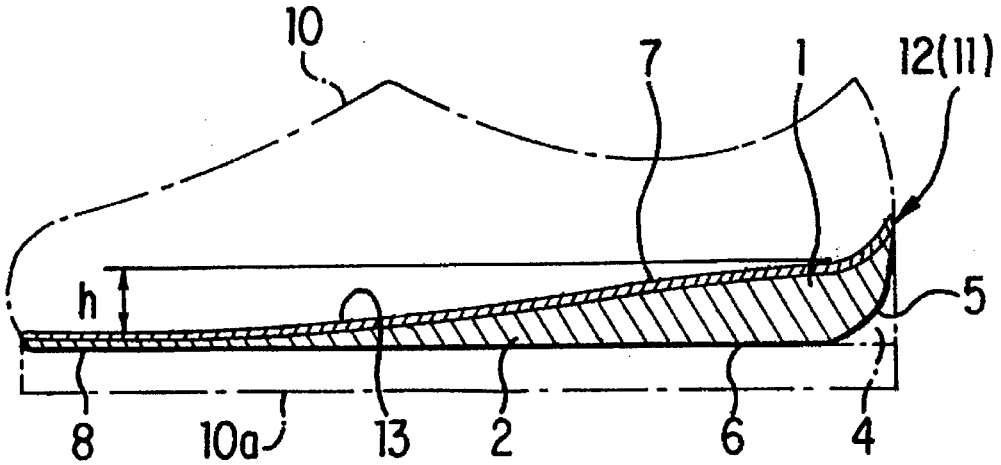
FIG. 1 is a sectional view of an inside sole type of the insole of the present invention.

In FIG. 1, an inside sole (insole) 12 is formed by being adhered to the surface of a sole 10*a*, and the structure thereof is shown longitudinally in cross section along the total length of the inside sole 12, i.e. from the toe 8 to the trailing end of the heel 1, the thickness thereof gradually increasing from the front portion of the arch of the foot 2 to the uppermost portion of the heel 1 forming a slope 7. The surface of this slope 7 is preferably provided with a curvature corresponding to the bottom of the foot not shown. The height of the heel 1 is set in a range between 15 mm and 35 mm from the level of the toe 8, within which range the necessary dimensions are selected according to the purpose for which the shoes are to be worn and the absorbing function necessitated.

Figure 2:
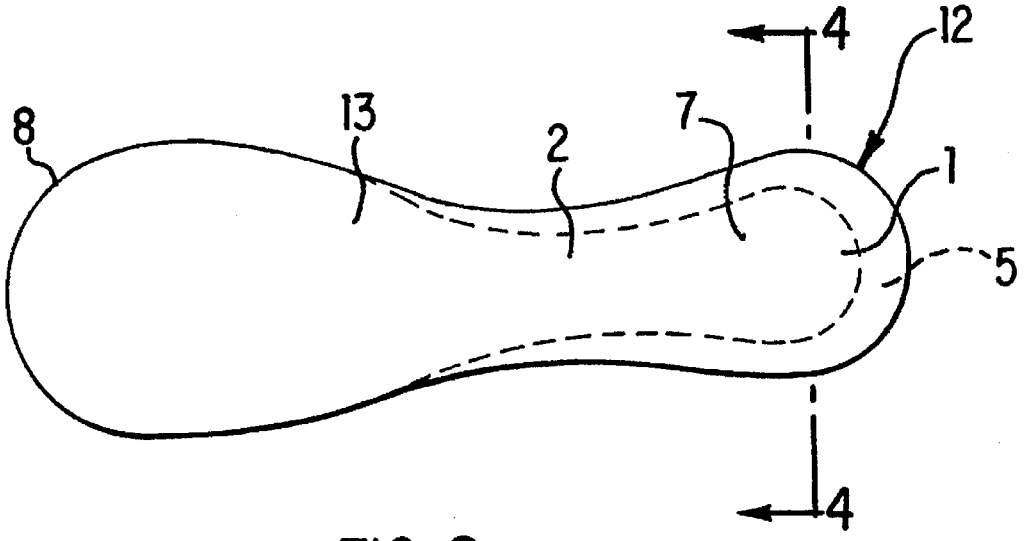
FIG. 2 is a plan view of the insole of FIG. 1.

The heel 1, as seen in FIGS. 2 through 4, is cut at the bottom corner (or edge) in section, to form a long cavity 4 corresponding to the cutout portion 5 of the bottom corner.

This cavity is formed by being surrounded with three surfaces, i.e. the cut surface of the insole, the upper surface of the sole 10*a* and the inner surface of the side wall of shoe 10. The configuration of the cavity 4 is not limited to that explained above, it being sufficient to form any figured cavity for shock absorption so as to allow distortion of the insole due to the load from the foot to be accommodated.

It is essential to provide any shape of cavity or any number of cavities there in order to allow the insole to deform due to the pressure applied by the foot when walking, in order to absorb the shock.

On the other hand, as to the bottom edge corresponding to the portion of the arch of the foot 2, as shown in FIGS. 1–3, there seems to be the same cavity as the heel 1 has, but actually there is no need to form a cavity there. Rather, the bottom edge, which covers the portion of the side wall of the shoe corresponding to the portion of the arch of the foot, makes a step between the side wall and the inside sole so that, accordingly, that portion of the inside sole should be cut at that bottom corner so as to avoid such a step, so that the cutting angles of the corners of the heel 1 and the arch of the foot 2 may be different to each other, that is, at least the cutting angle of the latter corner should preferably coincide approximately with the curvature of the side wall of the shoe corresponding to the arch of the foot.

Such insole 12 according to the present invention is generally made of an elastic resin having fine bubbles therein such as an ethylene vinyl acetate copolymer. And the upper surface of the insole 12 is covered with a surface layer 13 which is permeable to air, and adhered thereto.

Figure 7:
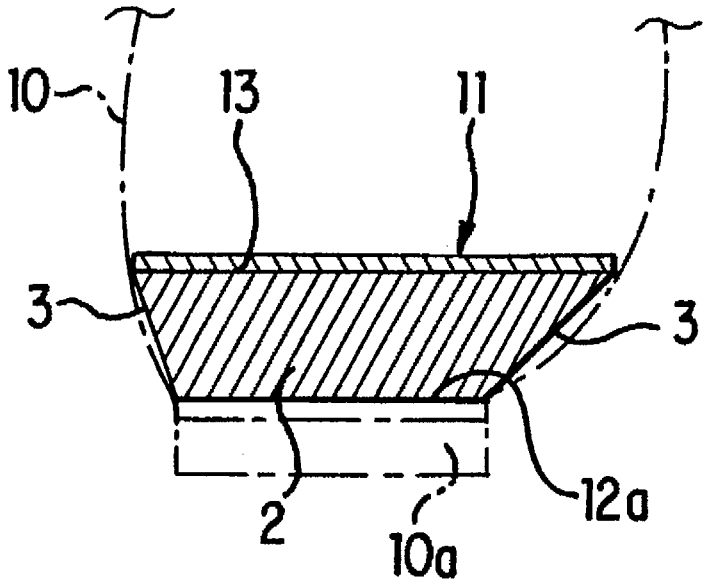
FIG. 7 is an enlarged sectional view along line 7—7 of FIG. 5

The second embodiment of the present invention is illustrated in FIGS. 5–7, and in this embodiment the loose sole 11 is formed similarly to the inside sole 12, but the loose sole 11 of this embodiment is of a type to be placed inside a shoe, and intended to be used as a replaceable loose sole for general use to fit shoes which are generally available in the market.

The difference between the first and second embodiments resides in that the loose sole of the second embodiment is separate from the sole of the shoe, and can be removably inserted into any other shoes.

Considering the general use of this type of insole, because there are cases where the bottom edge of the loose sole 11 partially covers the side wall of the shoe corresponding to the arch of the foot, due to the variety in dimensions of shoes, the bottom edge corresponding to the side wall of the shoe at the portion of the arch of the foot 2 is cut obliquely in section in order to coincide approximately with the curvature of the side wall. Thereby, the loose sole 11 is prevented from interfering with the ease of wearing a shoe at the portion of the arch of the foot.

What is claimed is:

1. A shoe, an insole for insertion in the shoe and a U-shaped cavity around a heel portion between the insole and the shoe when the insole is inserted in the shoe, the insole comprising a resilient substance of foam resin made of ethylene/vinyl acetate copolymer and having fine bubbles therein, wherein a thickness of the insole increases in a longitudinal direction from a front portion of the insole corresponding to an arch of a foot to a rear portion of the insole corresponding to a heel of the foot to give a slope from an uppermost portion of the insole corresponding to the heel to the portion of the insole corresponding to the arch of the foot, the uppermost portion of the insole being between about 15 millimeters and about 35 millimeters higher than a toe portion of the insole, a bottom edge of the insole having a cut surface in at least a heel portion of the insole, the shoe and the cut surface of the insole forming the U-shaped cavity around the heel portion and between the insole and the shoe when the insole is inserted into the shoe, a bottom surface of the insole surroundable by the U-shaped cavity, and forming a continuous plane for completely contacting an inner surface of the shoe, the resilient insole deforming into the cavity when pressure is applied to the insole by the foot to absorb shock.

2. The insole, the shoe, and the cavity according to claim 1, wherein said insole is an inside sole type formed integrally with an inner sole of the shoe.

3. The insole, the shoe, and the cavity according to claim 1, wherein said insole is a loose sole type which is placed inside the shoe to improve comfort thereof.

4. A shoe, an insole for insertion in the shoe and a U-shaped cavity around a heel portion between the insole and the shoe when the insole is inserted in the shoe, the insole comprising a resilient substance of foam resin made of ethylene/vinyl acetate copolymer and having fine bubbles therein, wherein a thickness of the insole increases in a longitudinal direction from a front portion of the insole corresponding to an arch of a foot to a rear portion of the insole corresponding to a heel of the foot to give a slope from an uppermost portion of the insole corresponding to the heel to the portion of the insole the insole, the cut surface forming the U-shaped cavity between the insole and the shoe when the insole is inserted in the shoe, a part of the bottom edge of the insole corresponding to the arch of the foot having an oblique cut so that a surface of the insole formed by the oblique cut coincides approximately with the curvature of a side wall of the shoe, the insole deforming into the cavity when pressure is applied to the insole by the foot to absorb shock, and a bottom surface of at least the heel portion of the insole forms a continuous plane for completely contacting an inner surface of the shoe.

5. The insole, the shoe, and the cavity according to claim 4, wherein the insole is an inside insole type formed integrally with an inner sole of the shoe.

6. The insole, the shoe, and the cavity according to claim 4, wherein the insole is a loose sole type insertable inside the shoe to improve comfort.

7. A shock absorbing footwear assembly, comprising:

an insole comprising foam resin made of ethylene/vinyl acetate copolymer and having fine bubbles therein, wherein a thickness of the insole increases in a longitudinal direction from a front portion of the insole corresponding to an arch of a foot to a rear portion of the insole corresponding to a heel of the foot to give a slope from an uppermost portion of the insole corresponding to the heel to the portion of the insole corresponding to the arch of the foot, the uppermost portion of the insole being between about 15 millimeters and about 35 millimeters higher than a toe portion of the insole, a bottom edge of the insole having a cut surface in at least a heel portion of the insole, a bottom surface of the insole bounded by the cut surface in at least the heel portion, a part of the bottom edge of the insole corresponding to the arch of the foot having an oblique cut;

a shoe having a space to accommodate an insole, wherein the bottom surface forms a continuous plane and completely contacts an inner surface of the shoe, and a surface of the insole formed by the oblique cut coincides approximately with the curvature of a side wall of the shoe; and a cavity formed in a U-shape around the heel portion of the insole by an inner surface of the shoe and the cut surface in at least the heel portion of the insole, wherein the insole deforms into the cavity when pressure is applied to the insole by the foot to absorb shock.

8. An insole of a shoe according to claim 7, wherein the insole is an inside insole type formed integrally with an inner sole of the shoe.

9. An insole of a shoe according to claim 7, wherein the insole is a loose sole type insertable inside the shoe to improve comfort.

* * * * *